US007088231B2

(12) United States Patent
Suzuka et al.

(10) Patent No.: US 7,088,231 B2
(45) Date of Patent: Aug. 8, 2006

(54) ANTITHEFT SYSTEM

(75) Inventors: Takuya Suzuka, Daito (JP); Hiroshi Yoshida, Sanda (JP)

(73) Assignee: Sensormatic Electronics Corporation, Boca Raton, FL (US)

( * ) Notice: Subject to any disclaimer, the term of this patent is extended or adjusted under 35 U.S.C. 154(b) by 199 days.

(21) Appl. No.: 10/483,542

(22) PCT Filed: Jul. 8, 2002

(86) PCT No.: PCT/JP02/06895

§ 371 (c)(1),
(2), (4) Date: Sep. 13, 2004

(87) PCT Pub. No.: WO03/007260

PCT Pub. Date: Jan. 23, 2003

(65) Prior Publication Data

US 2005/0030173 A1 Feb. 10, 2005

(30) Foreign Application Priority Data

Jul. 12, 2001 (JP) ..... 2001-211659

(51) Int. Cl.
*G08B 1/00* (2006.01)

(52) U.S. Cl. ..... 340/531; 340/572.4; 340/571; 340/522; 367/199

(58) Field of Classification Search ..... 340/572.4, 340/572.1, 571, 531, 539, 572, 511, 507, 340/566, 568, 522, 628; 367/197–199
See application file for complete search history.

(56) References Cited

U.S. PATENT DOCUMENTS 5,451,929 A * 9/1995 Adelman et al. ..... 340/521
2005/0099296 A1* 5/2005 Matsudaira et al. ..... 340/566

* cited by examiner

*Primary Examiner*—Daniel Wu
*Assistant Examiner*—Travis Hunnings

(57) ABSTRACT

The present invention provides a burglar alarm system capable of accurately discriminating external noises approximate to an alarm such as background music, ambient noises, etc. and reverberations of an alarm attributable to an architectural design of the interior of a store, etc. from a legitimate alarm. A burglar alarm system of the present invention comprises an alarm unit attached to an object to be protected from theft to emit an alarm of a certain frequency in response to illegal conduct and an alarm sensor for emitting an alarm signal upon sensing an alarm from said alarm unit, wherein said alarm sensor has first and second determination means for evaluating an input signal containing an alarm from the alarm unit and external noises, and the first determination means evaluates a random external noise contained in the input signal (S4, S5) whereas the second determination means evaluates a reflected sound caused by reverberations of the alarm (S6, S7) to emit an alarm signal (S9).

10 Claims, 4 Drawing Sheets

ANTITHEFT SYSTEM

TECHNICAL FIELD OF THE INVENTION

The present invention pertains to an anti-theft system intended to protect goods for sale from theft, and in particular to a burglar-alarm system utilizing an alarm to be emitted by an alarm unit attached to such goods.

BACKGROUND OF THE INVENTION

An anti-theft system such as that illustrated in FIG. 4 has been commonly employed to prevent shop lifting, etc. at retail stores where compact disk cassettes, magnetic tape cassettes, clothing garments, etc. are displayed in such a manner as to be readily accessible to customers.

Such a conventional anti-theft system consists of a theft prevention gate 30 installed near an exit 40 of the store and an alarm unit 20 attached to an article 50. The theft prevention gate 30 incorporates a circuit board 31 and a transmission antenna (not shown), and the circuit board 31 is provided with a transmitting circuit (not shown) which transmits an alarm activation signal to the alarm unit 20.

As indicated in FIG. 5, the alarm unit 20 has a buzzer 22, a circuit board 23, a battery (not shown), etc., each of which is housed in a casing 21, and in the surface of which casing a plurality of alarm emitting holes 24 are provided and an alarm activation switch piece 25 is embedded. The buzzer 22, which is controlled by the circuit board 23, is designed to be activated when the alarm unit 20 is removed from the article 50 or passes through the theft prevention gate 30. As an alternative to providing the alarm unit 20 with the alarm activation switch piece 25, the alarm unit 20 may be attached directly to the article 50 by means of a wire, in which case when the alarm unit 20 senses that the wire has been removed or cut or passed through the theft prevention gate 30, the buzzer 22 is activated.

At a retail store, the article 50 with the alarm unit 20 affixed thereto is displayed on a rack. When a sales clerk sells the article 50 to a customer (s), he first sends a specified reset signal from an alarm deactivation device (not shown) to the circuit board 23 of the alarm unit 20 to set the alarm unit such that the buzzer 22 will not be activated, then removes the alarm unit 20 from the article 50 and hands the article 50 to the customer when payment is made.

On the contrary, when the alarm unit 20 is removed from the article 50 by a customer, the alarm activation switch piece 25 is also removed and the buzzer 22 is activated. Further, in a case that a customer leaves a store premises taking away the article 50 with the alarm unit 20 still attached thereto, the circuit board 23 of the alarm unit 20 receives an alarm activation signal from the transmission antenna of the theft prevention gate 30, in response to which the buzzer 22 is activated.

However, a checkout counter is usually at the back of a store, far away from the exit 40 of the store where the theft prevention gate 30 is installed and therefore, an alarm from the buzzer 22 that goes off at the exit 40 may not be readily audible from the checkout counter, especially in an environment where the back ground music is present or where many customers are present, etc.

With a view to solving the problem of the anti-theft device described above, a burglar alarm system such as illustrated in FIG. 6 is used as a supplementary device in which an alarm sensor device 10 provided with a microphone 11 is disposed near the theft prevention gate 30 or in a fitting room and the like where a customer could remove and destroy or conceal the alarm unit 20 so that an alarm sensor device 10 senses an alarm 12 from the alarm unit 20 and issues an alarm signal 13, which is sent through a wire or by wireless connection to a speaker 15 or lamp 16 disposed at a checkout counter 14 to alert store personnel at the checkout counter that the alarm has been activated.

Such a system as described above, however, suffers from a problem in that it may not be able to discriminate an external noise similar to that generated by an alarm, such as background music, ambient noise, etc. from a legitimate alarm or may mistake reverberations of an alarm for an external noise.

SUMMARY OF THE INVENTION

The present invention provides a burglar-alarm system capable of accurately identifying an external noise approximate to an alarm such as background music, ambient noise, etc. and reverberations of an alarm attributable to an architectural design of an interior of a store, etc.

A burglar-alarm system of the present invention comprises an alarm unit attached to an object to be protected from theft to intermittently emit an alarm of a certain frequency upon the occurrence of theft and an alarm sensor for sensing an alarm from the alarm unit and generating an alarm signal, wherein said alarm sensor has first and second determination means for evaluating an input signal containing said alarm and external noises and the first determination means determines if the input signal contains random external noises while the second determination means determines if the input signal contains reflected sound caused by reverberation of said alarm and if the first and second determination means both determine that the input signal is a legitimate alarm, an alarm signal is generated.

PREFERRED EMBODIMENT OF THE INVENTION

Figure 1:
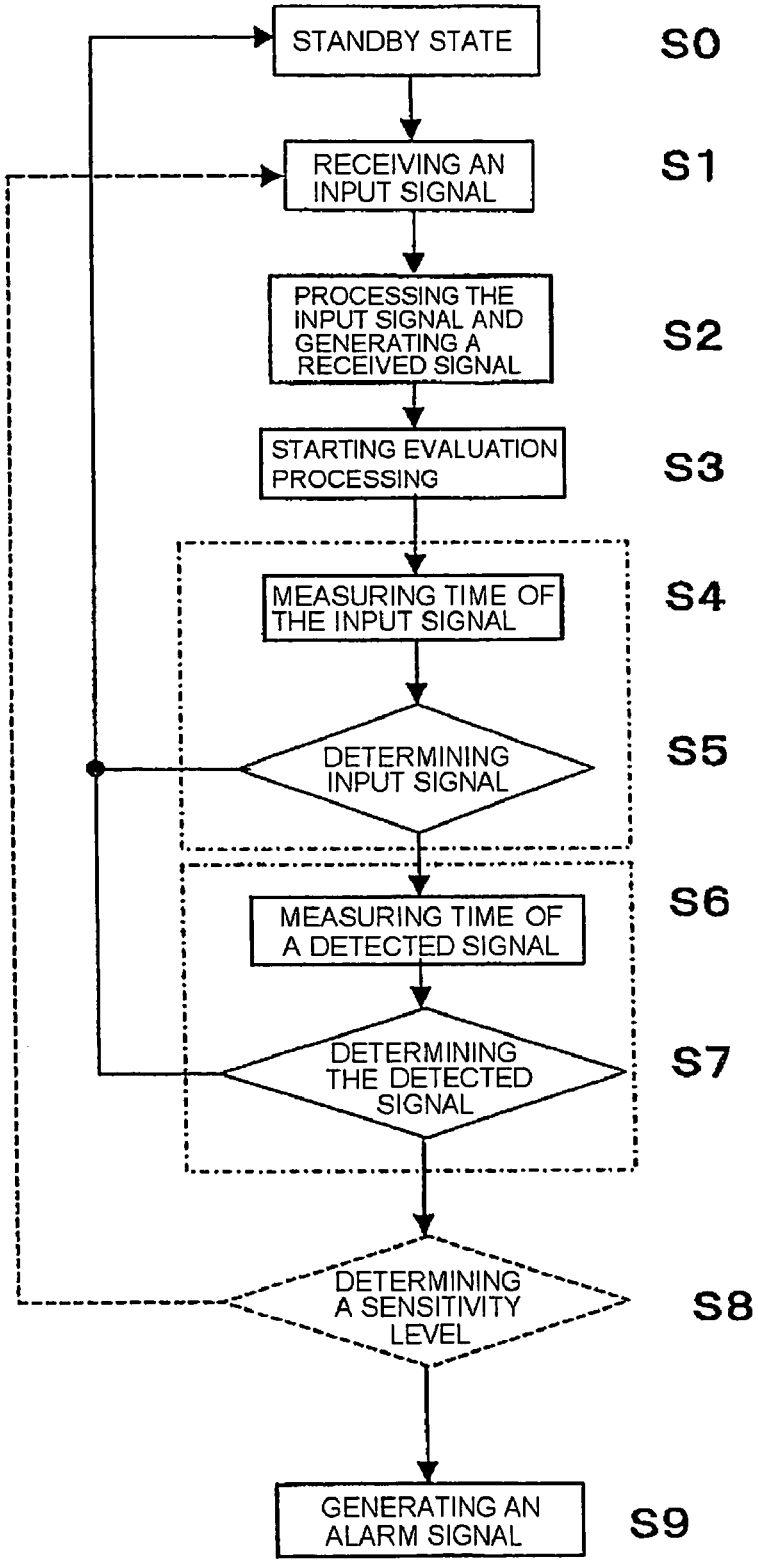
FIG. 1 is a flow chart describing the steps of an operation performed by an alarm sensor in accordance with an embodiment of a burglar alarm system of the present invention.
Figure 2:
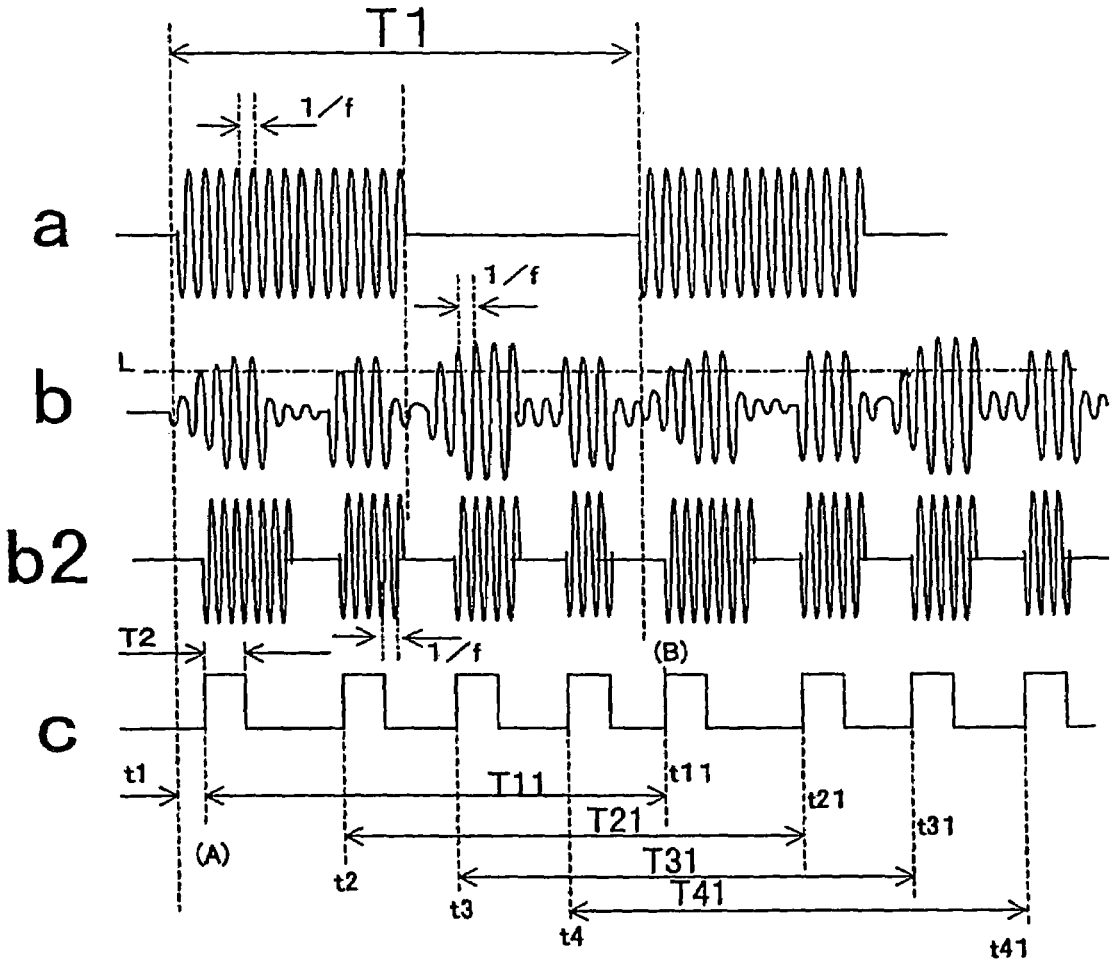
FIG. 2 shows signal waveforms of the present embodiment.
Figure 3:
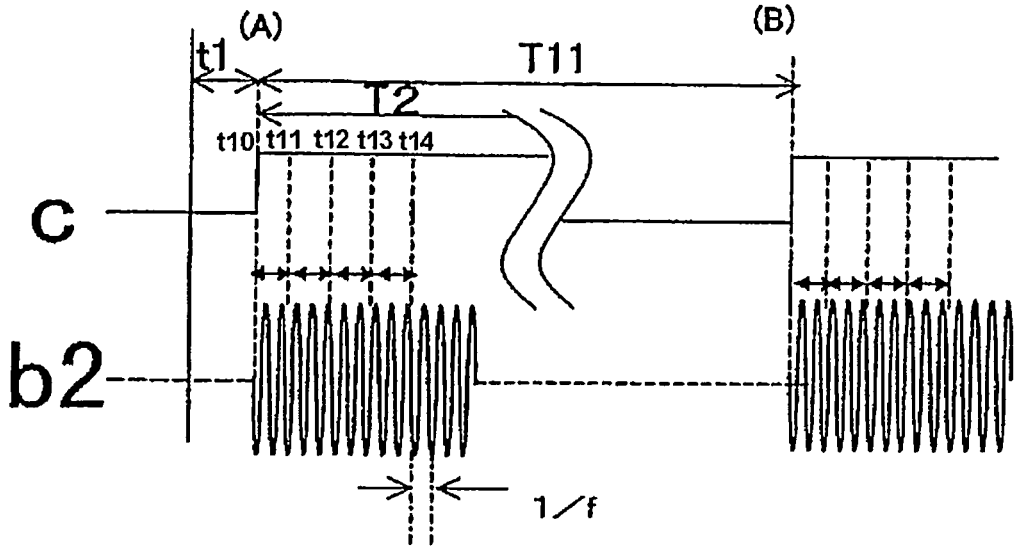
FIG. 3 is a detailed illustration of FIG. 2.
Figure 4:
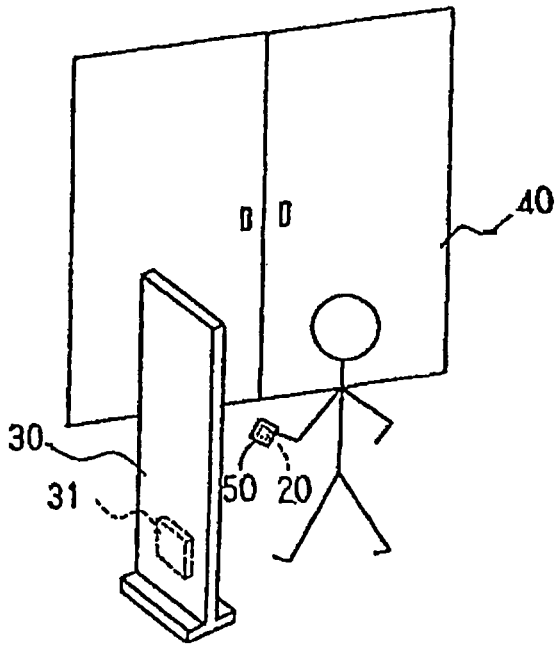
FIG. 4 is a diagram of a burglar alarm system.
Figure 5:
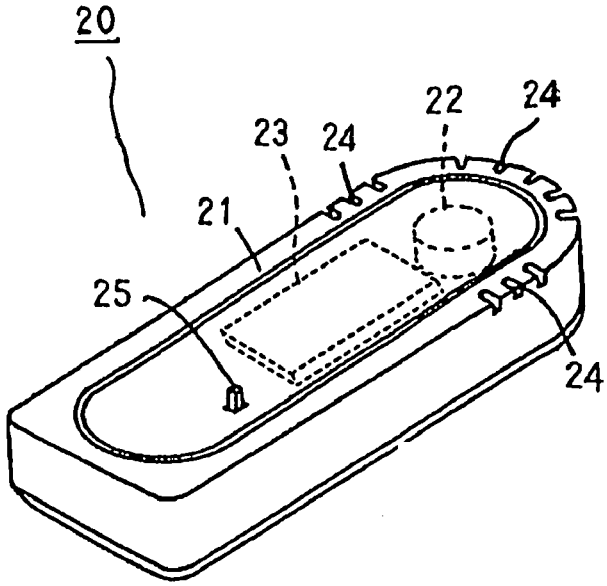
FIG. 5 is a perspective of an alarm unit in the burglar alarm system.
Figure 6:
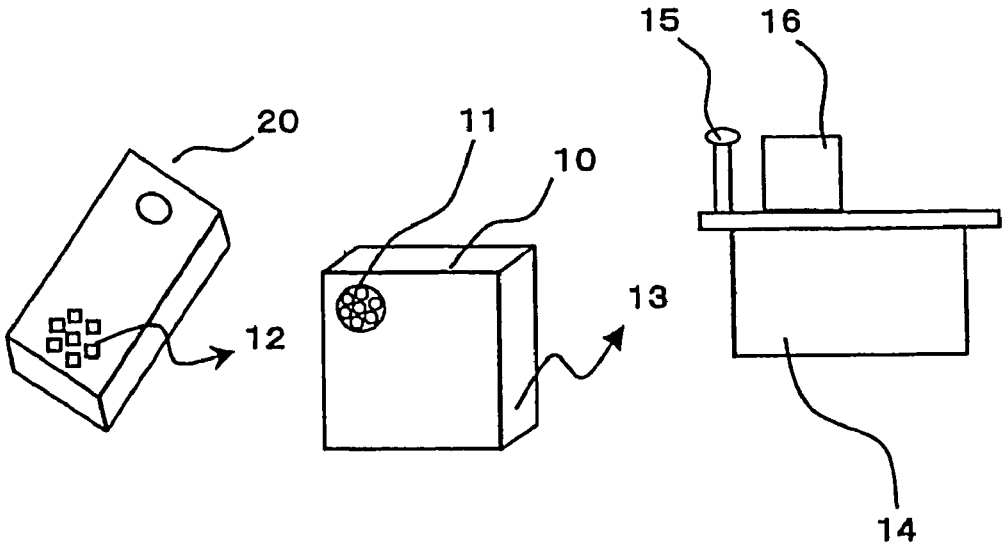
FIG. 6 is a diagram of another burglar alarm system.

FIG. 1 is a flow chart describing the steps of an operation performed by an alarm sensor of an embodiment of the present invention. FIGS. 2 and 3 show signal waveforms. Hereafter, the present invention will be described with reference to the drawings. It is assumed that the burglar-alarm systems indicated in FIGS. 4~6 incorporate either a circuit or software for performing a processing operation of an alarm sensor, and the systems will be described below with reference to FIGS. 1~3.

In FIG. 1, at step S0, the present burglar-alarm system is in standby mode, i.e., in the initial state. As stated, in response to an unauthorized removal of an alarm unit from goods or a store, the alarm unit emits an alarm. The alarm is generated by a buzzer drive signal having an intermittent waveform (cycle: T1, intermittent-duty rating: 50%) of a certain frequency f (cycle: 1/f) indicated in FIG. 2*a*.

At step S1, external noise and reverberations of the alarm are added to the alarm from the alarm unit to form an input signal whose sound pressure value fluctuates as described in FIG. 2*b*. The input signal is received by the microphone 11 of the alarm sensor installed near the theft prevention gate or in store premises, and a predetermined signal processing is performed on the input signal at the next step.

At step S2, the input signal (FIG. 2*b*) goes through a filter circuit for passing frequencies in the neighborhood of the frequency (f: for example, 3.125 KHz) of the alarm and a wave shaping circuit for only receiving sound pressure values greater than a specified value (indicated by the chain line L in FIG. 2*b*) to smooth out the sound pressure level and as a result, the waveform indicated in FIG. 2 b2 is obtained. From the thus wave-shaped input signal whose frequency is in the neighborhood of the frequency of the alarm and whose sound pressure value is not less than the predetermined sound pressure value, the alarm sensor generates and outputs a detected signal such as indicated in FIG. 2*c*. More specifically, a pulse waveform is generated for a period of T2 upon the rise of the input signal indicated in FIG. 2 b2. FIG. 2 represents a case where a sound pressure value exceeds a certain level after the time t1 has passed since the alarm unit issued the alarm. When the sound pressure value of the input signal drops and goes back up to exceed the certain level again, a pulse waveform is generated for a period of T2 again. In the present embodiment, a sound pressure level fluctuation described above occurs four times in a single intermittent waveform cycle T1 of the alarm.

At steps S3~S7, the input sound containing the alarm and external noises is evaluated. More specifically, at steps S4 and S5, an evaluation of input sound with respect to external noises is conducted where a frequency of the input signal is measured. At steps S6 and S7, an evaluation of input sound with respect to reverberations of the alarm is conducted where a rise time of the detected signal is measured. In determining whether or not an input signal contains external noises, the present system measures the time more than once during which a predetermined number of pulses are obtained and determines from a differential between the measured times whether or not the input signal is the alarm or external noise, utilizing the fact that the alarm emitted from the alarm unit has a certain frequency f whereas an external noise does not have such a certain frequency and furthermore, a frequency of an external noise greatly fluctuates during a period of time for a few tens of pulses to be generated. As for an evaluation with respect to reverberations of the alarm, the present system determines whether or not input sound contains reverberations of the alarm based on the fact that although a sound pressure value of reverberations of the alarm contained in an input signal fluctuates in various fashions depending on the architectural design of the interior of a store, mode of installation of the present burglar-alarm system, etc., the input signal is always a standing wave of the same pattern in the same environment.

Hereafter, an embodiment of the present invention will be described.

At steps S4 and S5, a frequency of the input signal b2 is determined. At step S4, it is determined whether or not the wave-shaped input signal b2 is the alarm (frequency f: 3.125 KHz). When the input signal passes through the filter circuit at step S2, the filter circuit only eliminates external noises whose frequencies are greatly different from the frequency of the alarm and does not eliminate external noises whose frequencies are in the neighborhood of the frequency of the alarm.

Therefore, as is indicated in FIG. 3, during the time of generation of the detected signal (T2: for example, 50 milliseconds), a predetermined number of waveforms (for example, thirty waves) of the input signal are counted from the rise time t10 of the input signal b2 and elapsed time from the time t10 through the time t11 at which the predetermined number of waveforms have been counted is measured. Similarly, the predetermined number of waveforms are counted more than once (for example, four times) to determine the times t11, t12, t13 and t14 sequentially.

Since a frequency of the alarm is approximately 3 KHz, it takes about 10 milliseconds for thirty waves of the input signal to be counted, and as measurement is conducted four times, approximately 40 milliseconds would be required. Therefore, T2 of 50 milliseconds is long enough for the measurement to be conducted four times. It is needless to say, however, that how many times the measurement is conducted merely constitutes a design condition that can be modified as needed.

At step S5, the differentials between the measured times (t11−t10, t12−t11, t13−t12, t14−t13) are respectively calculated and if it transpires that each differential does not exceed the predetermined time to be counted at the frequency of the legitimate alarm, it is determined that the frequency of the input signal is the frequency of the alarm and the procedure goes to the next step. On the other hand, if it transpires that even one of the differentials exceeds the predetermined time, it is determined that the input signal is an external noise and the procedure goes back to step S0 for standby mode.

At steps S6 and S7, the detected signal c is evaluated. At step S6, a rise time of each detected signal between the evaluation start point A where a detected signal rises and the point B where another detected signal rises after time for the single intermittent waveform cycle of the alarm from the alarm unit has passed is measured (t1, t2, t3, t4).

Similarly, a rise time of each detected signal during the next single intermittent waveform cycle of the alarm from the alarm unit is measured (t11, t21, t31, t41).

At step S7, the differentials between the measured times for the respective detected signals in the two intermittent waveform cycles are calculated (t11−t1, t21−t2, t31−t3, t41−t4), whereby cycles (T11, T21, T31, T41) for the respective detected signals are evaluated.

In other words, it is determined whether each of the cycles (T11, T21, T31, T41) of the respective detected signals does not exceed the cycle of the intermittent wave of the alarm ($T1\pm\alpha$, where $\alpha$ is error time, for example, 10 milliseconds). If it transpires that each time cycle is within T1±10 milliseconds, it is determined that the detected signals are the alarm. On the contrary, if it transpires that each time cycle is not within T1±10 milliseconds, it is determined that the detected signals are an external noise and the procedure goes back to the standby mode step S0.

Although the operations for the steps S4~S5 and the operations for the steps S6~S7 are performed in the order of S4~S5 and S6~S7 in the above embodiment, the operations for the steps S4~S5 and the operations for the steps S6~S7 may be performed concurrently or in the reversed order of S6~S7 and S4~S5.

At step S9, the alarm sensor issues an alarm signal, which is sent through a wire or by wireless connection to a speaker, lamp, etc. disposed at the checkout counter to alert store personnel. Since an alarm signal can be stopped by any known means such as a switch, transmission of a stop signal, etc., it will not be described further in this text.

Further, step S7 in the processing flowchart of the above embodiment may be followed by an additional step S8, where optional sensitivity levels (for example, High=no repeats 0, Middle=repeat once 1, Low=repeat twice 2) are set to add another evaluation condition (indicated by the broken line in FIG. 1), so that the operations at steps S1~S7 are repeated according to the level to thereby adjust the evaluation precision. More specifically, if the sensitivity level is Middle, the procedure S4~S6 is repeated once, and if the sensitivity level is Low, the procedure S4~S6 is repeated twice, whereby the evaluation standard is raised and sensitivity levels of the sensors are lowered in order.

Still further, although the number of times that a frequency of received sound is evaluated may be changed according to a pattern of a detected signal in the above-described embodiment, it is a matter of design variation and evidently, it may be changed in various other ways.

Still further, in evaluating detected signals, a time cycle of each received signal in a single intermittent waveform cycle of the alarm is evaluated in the above embodiment. However, it is not limited to the above mode of embodiment as long as it is possible to determine that a rise time of each received signal in a single intermittent waveform cycle is the same in every intermittent cycle.

The present invention is in no way restricted by the disclosed embodiment and other modifications and variations will be apparent to persons skilled in the art. The present invention is restricted only by the scope of the claims of the present invention.

The invention claimed is:

1. In a burglar alarm system comprising an alarm unit attached to an object to be protected from theft to intermittently emit an alarm of a certain frequency in response to illegal conduct and an alarm sensor for emitting an alarm signal upon sensing an alarm from said alarm unit, said alarm sensor comprising first and second determination means for an input signal containing said alarm and external noises, wherein the first determination means determines if the input signal contains random external noises while the second determination means determines if the input signal contains reflected sound generated as a result of a reverberation of said alarm; and if the first and second determination means both determine that the input signal is a legitimate alarm, an alarm signal is generated.

2. The burglar alarm system as defined in claim 1, wherein said first determination means measures the frequency of said input signal.

3. The burglar alarm system as defined in claim 1, wherein said second determination means measures a fluctuation cycle of a sound pressure value of said input signal that is generated in each intermittent cycle of said alarm.

4. In a burglar alarm system comprising an alarm unit attached to an object to be protected from theft to emit an alarm of a certain frequency in response to illegal conduct and an alarm sensor for emitting an alarm signal upon sensing an alarm from said alarm unit, said alarm sensor comprising: a detector circuit for generating detected signals for a predetermined time period if a sound pressure value of an input signal containing said alarm and an external noise is not less than a predetermined value; a first determination means; and a second determination means, wherein when receiving an input signal, said first determination means measures a time more than once required for a predetermined number of waveforms to be counted and determines, based on whether or not each differential between the measured times is within a predetermined time, whether or not the input signal is a random external noise; and said second determination means measures a rise time of each of the detected signals generated in each cycle of intermittent waveform of said alarm, measures a rise cycle of each of the detected signals, determines whether or not the detected signals are a reflected sound generated as a result of a reverberation of said alarm and issues an alarm signal.

5. The burglar alarm system as defined in claim 4, wherein it is determined by repeating a determination operation by said first and second determination means whether or not the input signal is an alarm.

6. A burglar alarm method comprising the steps of:

evaluating a random external noise contained in an input signal containing an alarm, which intermittently generates a certain frequency in response to illegal conduct, and external noises;

evaluating a reflected sound caused by reverberation of said alarm; and emitting an alarm signal when the results of the both evaluations indicate that said input signal is an alarm.

7. The burglar alarm method as defined in claim 6, wherein the step of evaluating said external noise includes a step of measuring the frequency of said input signal.

8. The burglar alarm method as defined in claim 6, wherein the step of evaluating said reflected sound includes a step of measuring a fluctuation cycle of a sound pressure value of said input signal that is generated in each intermittent cycle of said alarm.

9. A burglar alarm method comprising the steps of:

generating a detected signal for a predetermined time period when a sound pressure value of an input signal containing an alarm that intermittently generates a certain frequency in response to illegal conduct and an external noise is not less than a predetermined sound pressure value;

determining whether or not a received input signal is a random external noise, by measuring a time more than once required for a predetermined number of waveforms of the input signal to be counted and determining whether or not each differential between the measured times is within a predetermined time;

determining, by measuring rise time of one or more detected signals generated in each cycle of the intermittent waveforms of said alarm and measuring a rise cycle of each of the detected signals, whether or not the input signal is a reflect sound caused by reverberation of the alarm; and generating an alarm signal.

10. The burglar alarm method as defined in claim 9, wherein said determining steps are repeated more than once, thereby determining whether or not the input signal is a legitimate alarm.

* * * * *